US005437724A

United States Patent [19]

Dansereau et al.

[11] Patent Number: 5,437,724

[45] Date of Patent: Aug. 1, 1995

[54] MASK AND GRIT CONTAINER

[75] Inventors: Richard J. Dansereau, Cromwell; Robert G. Adinolfi, Manchester; Joseph J. Parkos, Jr., East Haddam, all of Conn.

[73] Assignee: United Technologies Corporation, Hartford, Conn.

[21] Appl. No.: 137,656

[22] Filed: Oct. 15, 1993

[51] Int. Cl.[6] ..... B05C 13/02

[52] U.S. Cl. ..... 118/76; 118/500; 204/224 R; 204/240

[58] Field of Search ..... 118/76, 500; 204/224 R, 204/240; 205/109, 110, 135; 210/231, 226

[56] References Cited

U.S. PATENT DOCUMENTS

| | | | |
|---|---|---|---|
| 3,156,632 | 11/1964 | Chessin et al. | 118/76 |
| 3,497,065 | 2/1970 | Johnson, Jr. | 210/231 |
| 4,169,020 | 9/1979 | Stalker et al. | 204/110 |
| 4,227,703 | 10/1980 | Stalker et al. | 277/53 |
| 4,232,995 | 11/1980 | Stalker et al. | 415/173.4 |
| 4,234,397 | 11/1980 | Torrey | 204/129.35 |
| 4,302,316 | 11/1981 | Nester | 204/224 R |
| 4,605,483 | 8/1986 | Michaelson | 204/224 R |
| 4,608,128 | 8/1986 | Farmer et al. | 205/110 |
| 4,610,698 | 9/1986 | Eaton et al. | 51/295 |
| 4,786,389 | 11/1988 | Moffitt | 204/224 R |
| 4,818,833 | 4/1989 | Formanack et al. | 219/634 |
| 4,851,188 | 7/1989 | Schaefer et al. | 419/9 |
| 4,884,820 | 12/1989 | Jackson et al. | 277/53 |
| 4,964,964 | 10/1990 | Murphy | 204/224 R |
| 5,074,970 | 12/1991 | Routsis et al. | 205/122 |
| 5,076,897 | 12/1991 | Wride et al. | 205/110 |

*Primary Examiner*—W. Gary Jones
*Assistant Examiner*—Laura E. Edwards
*Attorney, Agent, or Firm*—Charles E. Sohl

[57] ABSTRACT

The present invention relates to a tool for accurately controlling the location, volume and containment of an abrasive grit material during a plating operation wherein the grit material and a matrix metal are deposited onto a tip portion of at least one workpiece. The tool of the present invention has an inner component with slots for receiving the workpieces to be coated. The tool also has an outer components having a plurality of through slots for permitting a plating solution to flow therethrough and into a space defined by the inner and outer components. The tool further has a slot defined by portions of the inner and outer component for introducing the abrasive grit material into the space. A screen is provided over the slots in the outer component. The screen helps maintain the abrasive grit material within the space while permitting plating solution to flow into the space. The tool of the present invention further has a trough for collecting unused grit material. A method for forming a coating on a tip portion of a workpiece or workpieces using the tool of the present invention is also disclosed.

19 Claims, 2 Drawing Sheets

MASK AND GRIT CONTAINER

BACKGROUND OF THE INVENTION

The present invention relates to a tool for allowing an abrasive grit material to be incorporated into a coating being applied to a tip of at least one workpiece, such as an airfoil blade, in an array of workpieces, such as an array of airfoil blades used in jet engines, and to a method for repairing at least one airfoil blade in an array of airfoil blades using said tool.

It is known to provide at the tip of a gas turbine blade a tip portion comprising abrasive particles which are embedded in a matrix, the tip being intended to run against the surface of a shroud of a material which is softer than the abrasive particles. By this means, it is possible to produce, by the abrasive action of the particles on the shroud, a gap between the tip and the shroud which is very small, thus minimizing gas losses. U.S. Pat. Nos. 4,169,020, 4,232,995 and 4,227,703, all to Stalker et al., illustrate a turbine blade tip having a coating containing abrasive particles entrapped within a metal matrix. The abrasive tip portion is formed by depositing abrasive particles and a metal matrix concurrently on an inner tip portion of the turbine blade after the inner portion has been bonded to a projection body. This codeposition of matrix material and particles is accomplished electrolytically from an electrodeposition bath in which there are suspended abrasive particles formed from aluminum oxide, cubic boron nitride (CBN), or other abrasive carbides, oxides, silicides, or nitrides.

U.S. Pat. No. 4,608,128 to Farmer et al. illustrates a method for applying abrasive particles to an article surface which includes providing an electrically nonconductive tape and particle member for use in an electrodeposition type system. The tape includes pores large enough to allow passage of electrodeposition current and electrolyte solution but smaller than the size of the abrasive particles to be retained on the tape. The tape has a porous adhesive layer of relatively low tack level, the adhesive carrying the abrasive particles through a first or relatively weak bond. A metallic coating is electrodeposited through the pores of the tape and the adhesive onto the article surface and about the abrasive particles in contact with the surface. This bonds the abrasive particles to the article surface primarily through a second bond between the metallic coating and the abrasive particle which is stronger than the first, relatively weak bond. Thereafter, the tape and particle member is separated at the first bond from the abrasive particles bonded to the article surface.

U. S. Pat. No. 4,610,698 to Eaton et al. illustrates a process wherein a combination of sintering, plasma arc spraying, hot isostatic pressing and chemical milling is used to form an abrasive surface on a turbine blade. Alumina coated silicon carbide particulates are clad with nickel and sinter bonded to the surface of a superalloy turbine blade tip. An impermeable layer of plasma arc sprayed superalloy matrix is deposited over the particulates and then has its inherent voids eliminated by hot isostatic pressing. The abrasive material so formed on the surface is then machined to expose the particulates. Next a portion of the matrix is removed so that the machine particulates projected into space and are thus best enabled to interact with the abradable ceramic air seals in a gas turbine engine.

U.S. Pat. Nos. 4,818,833 to Formanack et al. and 4,851,188 to Schaefer et al. illustrate yet another method and apparatus for fabricating a turbine blade having a wear resistant layer sintered to the blade tip surface. The abrasive, wear resistant layer is applied to the tip surface of a superalloy gas turbine blade by a high temperature sintering operation which reduces a high strength bond between the layer and the blade, minimizes gamma prime phase growth, and prevents recrystallization in the blade. An inductively heated graphite susceptor is used to heat the blade and a refractory metal shield is used to surround the airfoil and root portions of the blade while leaving the tip portion exposed to the heat source.

U.S. Pat. No. 4,884,820 to Jackson et al. relates to a wear resistant, abrasive laser-engraved ceramic or metallic carbide surface for rotary labyrinth seal members. The tip is provided with a ceramic or metallic coating bonded thereto. The surface of the coating has a plurality of laser-formed depressions and is used to provide a wear resistant, cutting surface capable of cutting into a second member.

U.S. Pat. No. 5,074,970 to Routsis et al. relates to a method for applying an abrasive layer to titanium alloy compressor airfoils. The method described in this patent includes the application of several layers of nickel, one of which includes abrasive particulates. More specifically, the method comprises the steps of applying a first nickel layer having a thickness of about 12 to 18 microns directly to the blade tip surface; applying a second nickel layer to the first nickel layer, the second layer being less than about 1 micron in thickness; electroplating a third nickel layer onto the second nickel layer, and while the third layer is being electroplated, submerging the blade tip in a slurry of plating solution and electrically nonconductive abrasive particulates disposed upon a membrane permeable to electric current and plating solution, wherein the particulates in the slurry are entrapped in the third layer by the continued electroplating of nickel; applying a fourth nickel layer onto the third nickel layer wherein the combined thickness of the third and fourth nickel layers is between about 50 and 95% of the average particulate dimension; and heat treating the plated component.

U.S. Patent No. 5,076,897 to Wride et al. also relates to a method of producing a gas turbine blade having an abrasive tip. The method described in this patent comprises producing a binding coat on the tip of the blade body by electrodeposition, the binding coat comprising MCrAlY where M is one or more of iron, nickel and cobalt, anchoring coarse particles of an abrasive material to the binding coat by composite electrodeposition of the particles and an anchoring coat from a bath of plating solution having the abrasive particles suspended therein, and then plating an infill around the abrasive particles. The anchoring coat may be of cobalt, nickel or MCrAlY and preferably has a thickness less than 30 microns. The infill material may also be MCrAlY. Preferably, the deposition of the infill is accompanied by vibration of the blade in a direction which is substantially vertical and substantially along the axis of the blade.

In copending patent application Ser. No. 08/138,530, filed Oct. 15, 1993, entitled METHOD AND APPARATUS FOR CBN TIPPING OF INTEGRALLY BLADED ROTORS (Attorney Docket No. EH-9640 m), a method and apparatus for forming an abrasive surface on the tip portions of a plurality of airfoils is described. The apparatus includes a device for containing the abrasive grit material to be incorporated into the coating applied to the tips. The grit containment device described therein has a solid, substantially L-shaped barrier member which is placed over the tip portions of the airfoil blades being coated and a screen attached thereto which surrounds the periphery of the airfoil blades. The screen together with the barrier member define a channel in which the abrasive grit material is located during the coating operation.

Since the development of this containment device, it has been found that the use of the screen in this manner is disadvantageous in that it has insufficient structural strength to withstand bending and other forces which are generated during the coating operation. As a result, grit material can leak into the plating solution and become unretrievable. This is undesirable because the abrasive grit material is quite expensive. Still further, this containment device is not particularly well suited for use in coating a single workpiece.

SUMMARY OF THE INVENTION

Accordingly, it is an object of the present invention to provide a stand-alone tool which permits the formation of an abrasive coating on tip portions of singular or multiple workpieces with a minimum usage of grit material and setup time.

It is a further object of the present invention to provide a tool as above which effectively contains the abrasive grit material in a defined space and permits the reclamation of unused grit material.

Still further, it is an object of the present invention to provide a tool as above which can be used as part of a larger fixture assembly.

It is also an object of the present invention to provide an improved method for forming an abrasive surface on the tip of a workpiece.

Still other objects and advantages of the present invention will become more apparent from the following description and drawings wherein like reference numbers depict like elements.

The foregoing objects and advantages are attained by the tool and the method of the present invention.

In accordance with the present invention, a tool is provided which allows an abrasive grit material to be incorporated into a coating being applied to a tip of at least one workpiece in an array of workpieces. The tool has an inner component and an outer component which together define a space into which the abrasive grit material to be incorporated into the coating is introduced. The outer component has a first set of through slots for enabling a plating solution or bath to flow into the space defined by the inner and outer components and into contact with the abrasive grit material and the tip portions being coated. A screen is affixed to an inner wall of the outer component so as to insure that the abrasive grit material within the space does not flow out through the first set of slots into the plating bath. The inner component of the tool has a second set of through slots which permit the tip portions of the workpieces to be coated to be inserted into the space. Typically, a tool in accordance with the present invention will have three to five slots for receiving the tip portions of three to five workpieces. The tool of the present invention further includes a trough positioned along an exterior wall of the inner component. The trough retrieves any abrasive grit material which flows between the outer surfaces of the workpieces being coated and the slots in the inner component. The tool further includes means for assembling and disassembling the inner and outer components in order to permit further retrieval of unused grit material.

When using the tool of the present invention to repair the tip portion of at least one workpiece in an array of workpieces, the tool is mounted to the array of workpieces so that the tip portions of at least three workpieces extend into the space defined by the inner and outer components. Thereafter, the array of workpieces with the mounted tool are placed into a tank containing a plating bath having a matrix material in solution. Abrasive grit material is then introduced into the tool and electrical current is passed through the plating solution so that the matrix material and the abrasive grit material are codeposited onto the tip portion of at least one of the workpieces.

The tool of the present invention has been found to have particular utility in the repair of airfoil blades such as those in compressor and turbine blade arrays used in jet engines.

Other details of the tool and the method of the present invention are set out in the following description and the accompanying drawings.

DETAILED DESCRIPTION OF THE PREFERRED EMBODIMENT(S)

As previously discussed, it is desirable to provide the tip portions of airfoil blades used in gas turbine and compressor assemblies with an abrasive coating. Such a coating allows the tip portions to contact a surrounding member such as a shroud and abrade away a portion of the surrounding member so as to form a flow passage therebetween. The tool of the present invention is designed to facilitate the repair and/or the formation of an abrasive coating on one or more tips of one or more blades in an airfoil blade or array.

When forming abrasive coatings on the tips of airfoil blades, the grit material which goes into the coating must be held in intimate contact with the blade tip only. Additionally, the plating solution must be able to freely flow to the interface between the blade tip and the abrasive grit material. The tool of the present invention is designed to accurately control the location, volume, and containment of the abrasive grit material during the plating operation. It is also designed to retrieve any unused grit material.

The tool of the present invention has an inner component (10) and an outer component (12). The inner component is shown in perspective view in FIG. 1. As can be seen therein, it is arcuately shaped to reflect the overall curvature of the array of blades or workpieces.

Figure 1:
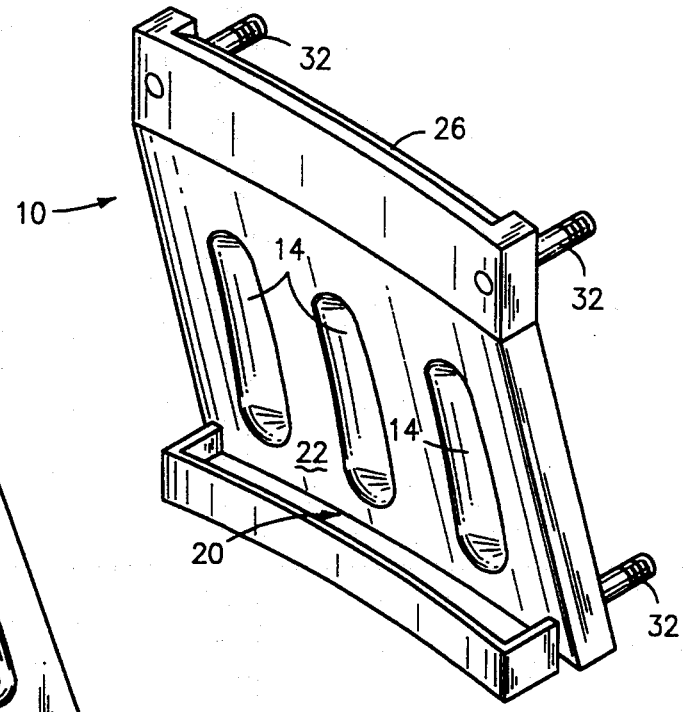
FIG. 1 is a perspective view of an inner component of the tool of the present invention.
Figure 2:
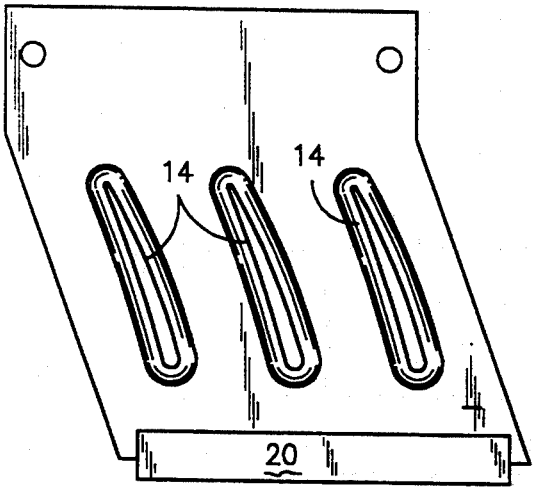
FIG. 2 is a front view of the inner component of FIG. 1.
Figure 3:
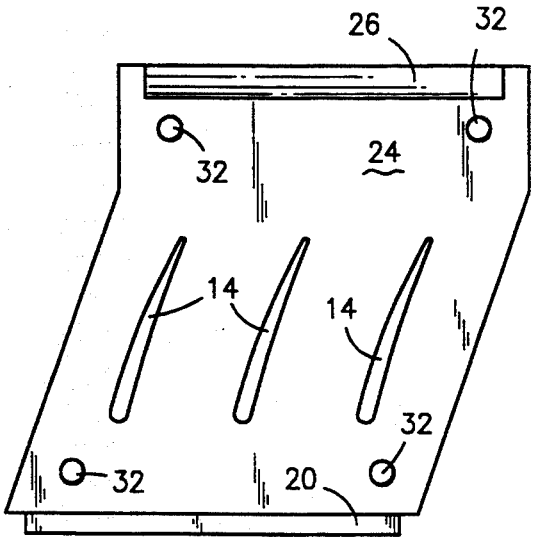
FIG. 3 is a rear view of the inner component of FIG. 1.

As shown in FIGS. 1-3, the inner component (10) is provided with a set of through slots (14). The number of slots (14) in the inner component is typically from three to five, although any desired number of slots could be cut into the component (10). The slots (14) are preferably slightly larger than the tip portions (16) of the airfoil blades being plated or coated. Additionally, the slots (14) have a shape substantially similar to the basic profile geometry of the blades (18).

The inner component (10) is formed from a flexible material to allow the tool to be easily installed on the blades (18) and to form an effective seal over the inserted blade tips (16). In a preferred embodiment of the present invention, the inner component (10) is formed from a rubber-like material.

A trough (20) is attached to or integrally molded with an outer wall (22) of the component (10). The trough (20) is provided to catch and retrieve any abrasive grit material which flows between surfaces of the blades (18) and the slots (14). The trough is also preferably formed from a flexible material such as a rubber-like material.

As shown in FIG. 3, the inner wall (24) of the component (10) is substantially planar. An angled portion (26) is provided. This angled portion forms part of a slot (28) for introducing the abrasive grit material (29) into a space (30) defined by the inner and outer components.

If desired, the inner component (10) may be manufactured with a plurality of screw members (32) embedded therein. The screw members may be used to fasten the inner and outer components together.

Figure 4:
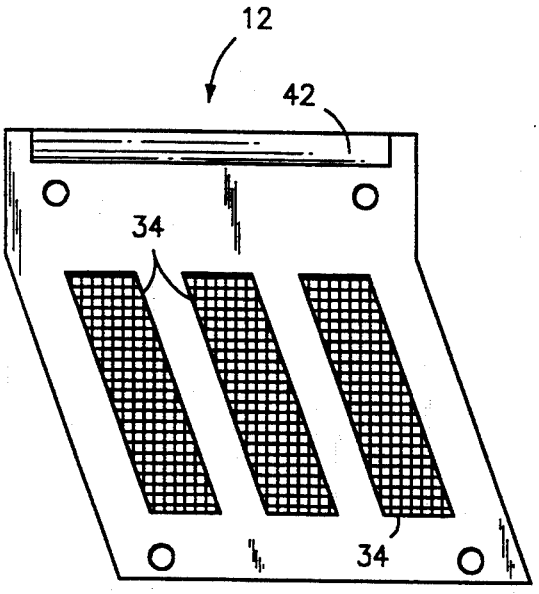
FIG. 4 is a front view of an outer component of the tool of the present invention.
Figure 5:
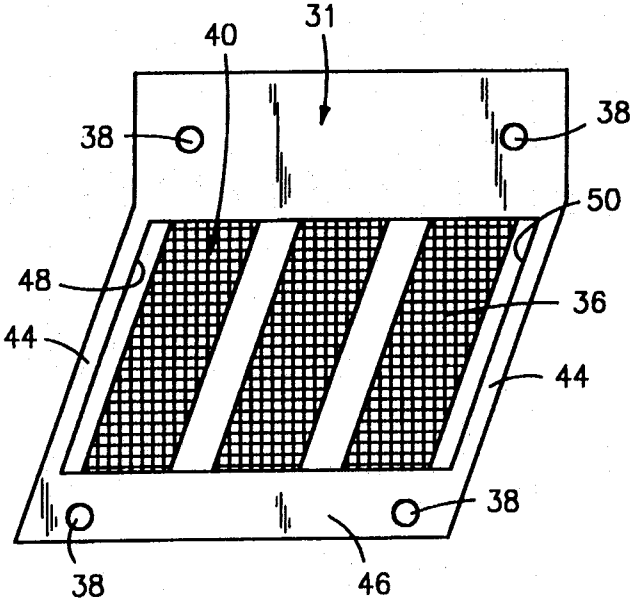
FIG. 5 is a rear view of the outer component of FIG. 4.

The outer component (12) is shown in FIG. 4 and 5. It too is arcuately shaped and has a curvature which is substantially identical to the curvature of the inner component. The primary purpose of the outer component is to maintain the necessary dimensional and volume requirements for the abrasive grit material. To this end, it is preferably formed from a material which is more rigid than the material forming the inner component (10). This more rigid material may also be flexible and a rubber-like material. If desired, however, the components (10, 12) could be formed from the same material.

As shown in FIG. 4, the outer component (12) has a set of through slots (34) which extend through the outer component. These slots are provided to allow the plating solution or bath to flow into the space (30) and into contact with the tip portion(s) (16) and the grit material within the space. A screen member (36), preferably formed from a polypropylene material, is affixed to an inner wall of the component (12) and covers the slots (34). Any suitable adhesive known in the art may be used to affix the screen member to the inner wall.

The screen member (36) allows the plating solution to flow into the space (30) while substantially preventing the abrasive grit material from flowing through the slots (34) and into the plating solution. Preferably, the screen member has openings sufficiently sized to provide the support function with respect to the grit material while permitting the necessary flow of plating solution.

As shown in FIG. 5, the outer component has a series of holes (38) for receiving the screw members (32).

The inner wall (31) of the component (12) has a recessed portion (40) in which the screen member (36) is seated. The recessed portion (40) with the substantially planar wall (24) of the inner component defines the space (30) for receiving the abrasive grit material. The inner wall of the outer component (12) also has an angled portion (42) formed therein which forms part of the slot (28) for introducing the abrasive grit material into the space (30).

The non-recessed sidewall and bottom portions (44 and 46) of the outer component are substantially planar and shaped to conform with the inner wall (24) of the inner component (10). As a result, when the inner and outer components are joined together, they are joined together in a sealing fashion which substantially prevents leakage of the grit material between the two joined components.

It should be noted that portions (48 and 50) of the sidewall surfaces of the recessed portion are angled. This is to permit the grit material to be properly located in the space (30) so that the grit material fully covers the tip portions (16) of the curved blades (18).

Figure 6:
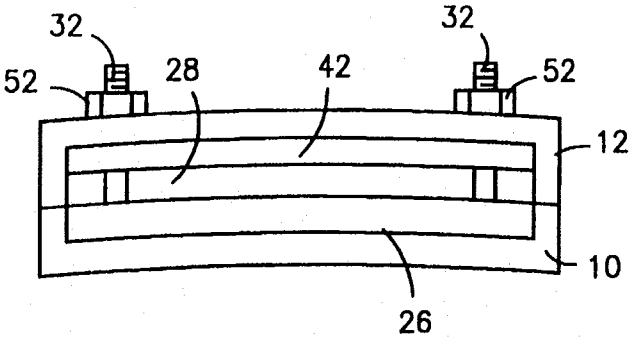
FIG. 6 is a top view of the inner and outer components assembled together.

FIG. 6 is a top view showing the inner and outer components (10 and 12) joined together. As can be seen from this figure, when joined together, the angled portions (26 and 42) define a slot (28) into which the abrasive grit material can be introduced. It should also be noted that nuts (52), having threaded portions (not shown) which engage mating threaded portions on the screw members (32), are used to assemble the inner and outer components together. The use of a screw-nut arrangement is desirable because it permits the tool to be easily disassembled for retrieval of the unused grit material and cleaning and thereafter be easily reassembled.

The tool of the present invention is particularly suited for assisting in the formation of an abrasive coating on tip portions (16) of one or more airfoil blades (18). Typically, prior to being subjected to a coating operation, the airfoil blades (18) and their tip portions (16) are prepared for receiving the coating. This pretreatment is preferably performed prior to the installation of the tool of the present invention.

The method for preparing the tip portions (16) is well known in the art and generally includes cleaning the blades, vapor honing the tip portions, applying a maskant material to the blades (18), manually removing the maskant material from the tip portions (16) so as to expose them, vapor blasting the exposed tip portions to clean them, and etching the exposed tip portions. Any technique known in the art may be used to carry out these precoating preparation steps. One approach for performing each of these pretreatment steps is described in co-pending patent application Ser. No. 08/138,530, filed on Oct. 15, 1993, (Attorney's Docket No. EH-9640 m), which is incorporated herein by reference.

Figure 7:
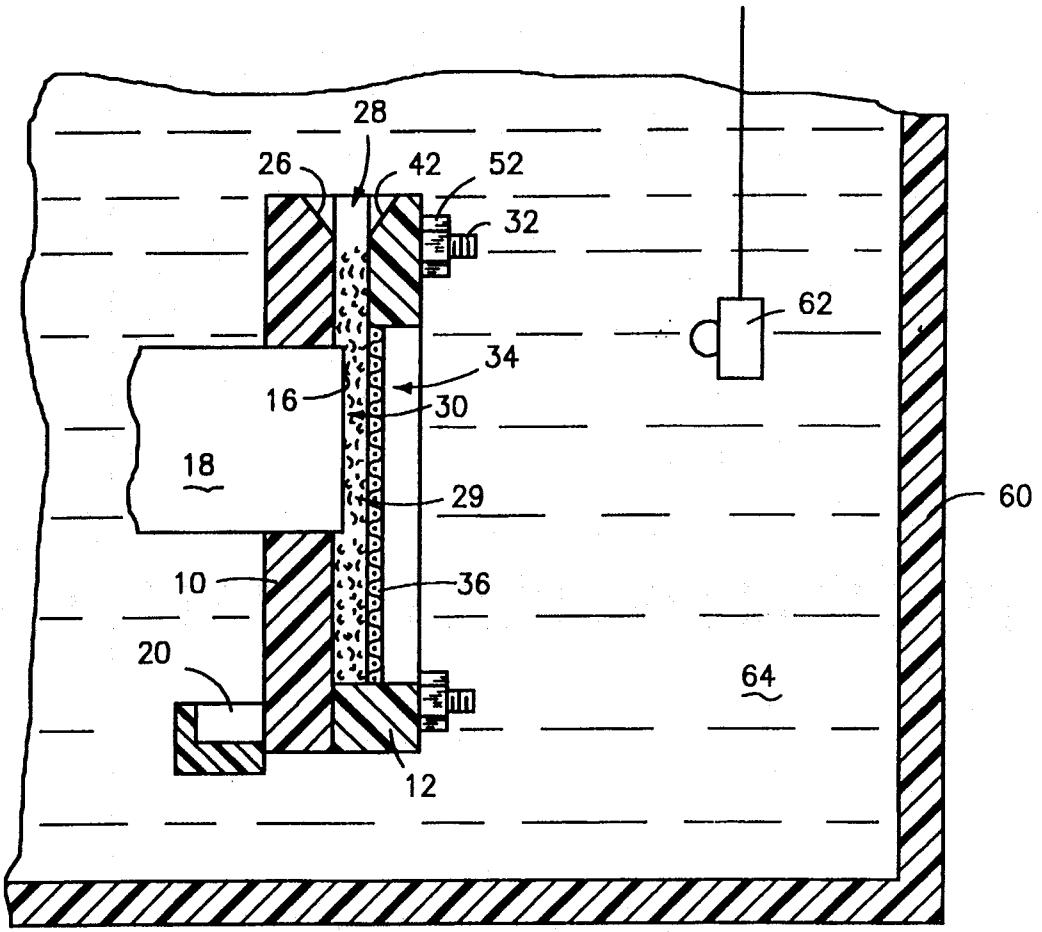
FIG. 7 is a sectional view of the tool of the present invention immersed in a plating solution.

After the pretreatment steps have been completed, the tool of the present invention is installed on the airfoil blade(s) to be treated. FIG. 7 illustrates a tool in accordance with the present invention in an installed position. After the tool has been installed, the array of blades with the installed tool are inserted into a plating tank (60). The array of blades is preferably electrically connected to a current source (not shown) to act as a cathode. One or more anodes (62) connected to the same power source may be immersed in the plating bath (64). The plating bath preferably contains a matrix material, such as nickel, to be codeposited along with an abrasive grit material such as cubic boron nitride. One plating bath which may be used to form an abrasive coating is a standard nickel sulfamate bath.

After the array and the tool are placed in the tank (60), an electric current of about 30 ASF and 0.846 amps is applied to the plating bath for about 10 minutes. This causes a light layer of the matrix material in the bath to bond to the tip portion (16). Thereafter, the current is lowered so as to continue a low level of plating. At this point, the abrasive grit material is introduced into the space (30) through the slot (28). The abrasive grit material preferably has a mesh size from about 100 to about 120 mesh. Sufficient grit material is introduced into the space (30) so as to completely cover the tip portions (16). Thereafter, the current is raised to 20 ASF at 0.564 amps for 30 to 35 minutes. The matrix material and the abrasive grit material are codeposited onto the tip portion(s) (16) of the blades with the matrix material acting as an overcoat.

After the desired coating has been formed, the array of blades with the installed tool of the present invention is removed from the tank (60). The tool is then removed from the blades. Unused grit material removed from the trough (20) and from the space (30). If desired, the coated blades may subjected to a post-coating treatment such as a heat treatment for stress relief.

As can be seen from the foregoing description, the tool of the present invention accurately controls the location, volume, containment and retrieval of the grit material being used in the coating formation operation. Loading the grit material, maintaining grit-to-tip dimensioning at contact, and retrieval of unused grit material are essential to controlling the quality and cost of a plating operation.

The flexible inner component (10) of the tool of the present invention maintains a tight seal around the airfoil surfaces while allowing quick installation and removal of the tool. The outer component (12) maintains the necessary dimensional/volume requirements.

As can be seen from the foregoing description, once the tool of the present invention has been installed over the blades, the grit material can be easily introduced through the top of the tool.

It should be recognized that the tool of the present invention can be used as a "stand alone" plating fixture or be used as part of a larger fixture assembly which completely surrounds the array of blades. It should further be recognized that the tool of the present invention permits the plating of singular or multiple blades with a minimal usage of grit material and setup time. This is especially important for repairs. Additionally, the tool of the present invention can be used in conjunction with sprayed or liquid maskants.

One of the principal advantages of the tool of the present invention is that it helps eliminate variables in plating processes. This is the result of simplifying the preparation of the blades for plating, loading and retrieving the grit material, and the strict dimensional control obtained during the plating process. Clearly, overall plating quality is improved by reducing the variability of the plating process.

It is apparent that there has been provided in accordance with this invention a mask and grit container which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A tool for allowing an abrasive grit material to be incorporated into a coating being applied to a tip of at least one workpiece in an array of workpieces, said tool comprising:

a first component and a second component;

said first and second components being shaped and mounted adjacent to each other and defining a space containing an abrasive grit material;

said first component having at least one first through slot for permitting a tip portion of said at least one workpiece to be coated to be inserted into said space, said at least one first through slot conforming to the tip of at least one workpiece to be coated;

said second component having at least one second through slot for enabling a plating solution to flow into said space; and a screen affixed to an inner wall of said second component, said screen covering said at least one second through slot so that said abrasive grit material does not flow through said through slots.

2. The tool of claim 1 further comprising:

said first component having a second set of through slots for permitting tip portions of workpieces to be coated to be inserted into said space.

3. The tool of claim 2 further comprising:

each of said slots forming said second set of through slots being slightly larger than the tip portions of said workpieces being inserted therethrough and having a geometry substantially similar to a basic geometry of said workpieces.

4. The tool of claim 2 further comprising:

means for retrieving abrasive grit material which flows around workpieces inserted into said slots forming said second set of through slots.

5. The tool of claim 4 wherein said retrieving means comprises a trough positioned along an exterior wall of said first component.

6. The tool of claim 1 further comprising said space being defined by a first angled surface on said first component and a second angled surface on said second component.

7. The tool of claim 1 further comprising:

means for joining said first and second components together.

8. The tool of claim 7 wherein said joining means comprises:

a plurality of screws extending from one of said first and second components;

a plurality of apertures in the other of said first and second components for receiving said screws; and nut means for fastening said components together and for allowing said components to be separated for maintenance purposes.

9. The tool of claim 1 further comprising:

both of said first and second components being arcuately shaped.

10. The tool of claim 1 further comprising:

both of said first and second components being formed from the same material.

11. The tool of claim 1 further comprising:

both of said first and second components being formed from a flexible material.

12. The tool of claim 1 further comprising:

said first component having a substantially planar inner wall;

said second component having a recessed portion in its inner wall; and said substantially planar inner wall of said first component and said recessed portion of said second component defining said space for said abrasive grit material.

13. The tool of claim 12 further comprising:

said recessed portion having angled sidewall surfaces for insuring proper location of said abrasive grit material.

14. A tool for accurately controlling the location and volume of an abrasive grit material to be applied to a tip portion of at least one airfoil blade in an array of airfoil blades as part of an electro deposited coating being formed on said tip portion, said tool comprising:

a first component and second component;

said first and second components together defining a space containing an abrasive grit material;

joining means to join said first and second components;

said first component having at least three slots extending therethrough for receiving tip portions of at least three adjacent airfoil blades, said at least three slots allowing said tip portions to extend into said space; and said second component having a plurality of slots extending therethrough for permitting a plating solution containing a matrix material to flow into said space; and a screen attached to an inner wall of said second component, said screen covering said slots extending through said second component;

whereby said first component maintains a seal over said at least three airfoil blades extending therethrough and said second component maintains dimensional and volume control of said abrasive grit material.

15. The tool of claim 14 further comprising:

an opening in a top portion of said tool through which said abrasive grit material is introduced into said space; and said opening being defined by angled portions of said first and second components.

16. The tool of claim 14 further comprising:

said first component having an substantially planar inner wall;

said second component having a recessed portion in its inner wall; and said substantially planar inner surface of said recessed portion defining said space.

17. The tool of claim 14 wherein each of said airfoil blades have a particular geometry; and each of said slots have a shape corresponding to said geometry of said airfoil blades.

18. The tool of claim 14 further comprising:

means for reclaiming unused abrasive grit material.

19. The tool of claim 18 wherein said reclaiming means comprises a trough along an exterior wall of said first component.

* * * * *